US007874446B2

(12) United States Patent
Spivey et al.

(10) Patent No.: US 7,874,446 B2
(45) Date of Patent: Jan. 25, 2011

(54) TRASH CONTAINER WITH COMPACTING LID

(75) Inventors: Patrick Spivey, Clarkston, GA (US); Kenneth C. Kreafle, Atlanta, GA (US)

(73) Assignee: Base Brands, LLC, Atlanta, GA (US)

( * ) Notice: Subject to any disclaimer, the term of this patent is extended or adjusted under 35 U.S.C. 154(b) by 476 days.

(21) Appl. No.: 11/972,881

(22) Filed: Jan. 11, 2008

(65) Prior Publication Data

US 2009/0179037 A1 Jul. 16, 2009

(51) Int. Cl.
*B65D 51/18* (2006.01)
*B30B 1/00* (2006.01)

(52) U.S. Cl. ..... 220/254.3; 220/578; 100/265

(58) Field of Classification Search ..... 220/212.5, 220/212, 495.06, 495.01, 810, 908.1, 908, 220/263, 262, 260, 756, 752, 367.1, 200, 220/254.6, 254.5, 254.3, 259.1, 256.1, 825, 220/348, 345.1, FOR. 203, FOR. 207, FOR. 204, 220/FOR. 192, 827; 100/211, 247, 265, 100/227, 228, 229 A, 233, 214, 246, 249, 100/240; D34/10, 9, 8, 7, 1
See application file for complete search history.

(56) References Cited

U.S. PATENT DOCUMENTS 3,261,545 A * 7/1966 Frazier ..... 232/43.2
3,552,332 A * 1/1971 Mattenley ..... 110/212
3,919,932 A 11/1975 Basuino
3,961,573 A * 6/1976 Schmidt ..... 100/100
4,103,608 A * 8/1978 Chenot ..... 100/345
4,183,295 A 1/1980 Peterson
RE30,509 E 2/1981 Peterson
4,331,074 A 5/1982 Behman
4,440,321 A 4/1984 Campbell et al.
4,593,615 A 6/1986 Kehl
4,649,813 A 3/1987 Kehl
4,656,937 A 4/1987 Turner, Jr.
4,658,720 A 4/1987 Massonnet
4,991,500 A 2/1991 Knapp
5,025,719 A 6/1991 Thomas
5,042,374 A 8/1991 Klepacki
5,050,762 A 9/1991 Giorgi
5,090,309 A 2/1992 Lai
5,220,866 A 6/1993 Mason, Jr. et al.
5,355,789 A 10/1994 Suzuki et al.

(Continued)

*Primary Examiner*—Anthony Stashick
*Assistant Examiner*—Robert J Hicks
(74) *Attorney, Agent, or Firm*—Wong, Cabello, Lutsch, Rutherford & Brucculeri LLP

(57) ABSTRACT

A trash container has a flexible, corrugated baffle attached to or integrated into the lid of the container. The baffle may have a handle and a compacting plate attached to it, and it allows a user to compact trash inside the trash container. Specifically, the flexible design of the baffle allows the compacting plate to compact trash inside the container when the baffle is extended into the container. After the trash inside the container is compacted, the baffle may spring back into its original shape. The lid structure, including the baffle, may be incorporated into the container, which may have other features, such as a foot pedal to raise and lower the lid. The baffle allows trash in the trash container to be reduced in size, allowing more trash to be placed in the container, while maintaining a simple design and keeping the user clean and safe.

20 Claims, 3 Drawing Sheets

U.S. PATENT DOCUMENTS

| | | | | |
|---|---|---|---|---|
| 5,730,047 | A | 3/1998 | Lindsey | |
| 5,845,567 | A | 12/1998 | Fischer | |
| 6,314,874 | B1 | 11/2001 | Martorella | |
| 6,851,357 | B1 | 2/2005 | Martorella et al. | |
| 6,889,604 | B2 | 5/2005 | Ernst | |
| 6,910,412 | B2 | 6/2005 | Ko | |
| 6,983,685 | B2 | 1/2006 | Ko | |
| 7,237,480 | B2 | 7/2007 | Ruddock | |
| 2003/0233950 | A1* | 12/2003 | Ko | 100/214 |
| 2007/0289967 | A1* | 12/2007 | Pierce et al. | 220/212 |
| 2008/0000912 | A1* | 1/2008 | Lin | 220/495.08 |
| 2008/0282912 | A1* | 11/2008 | Jardine et al. | 100/269.01 |
| 2010/0181313 | A1* | 7/2010 | Turina | 220/212 |

* cited by examiner

TRASH CONTAINER WITH COMPACTING LID

FIELD OF THE INVENTION

Embodiments according to this invention relate to improved waste containers. More specifically, embodiments according to this invention relate to a trash container having a flexible baffle incorporated into the lid for compacting trash.

BACKGROUND

Trash containers are well-known devices used to dispose of various kinds of waste. Many names for these containers exist, including, for example, "garbage cans," "trash cans," "waste bins" "dustbins," etc. Trash containers range from general purpose containers to specialized containers that are designed for specific types of waste. Several types of devices have been developed to reduce the size of waste in a trash container (e.g., to compact or compress the waste) before the waste is disposed. Compacting allows more waste to be disposed of before the trash container needs to be emptied, meaning that fewer trash bags are necessary when disposing of waste. Elaborate devices used in institutional or industrial environments for compacting trash use electrical devices such as motors or even us hydraulic systems. Other devices typically preferred for home or office use may have levers, numerous moving parts, or cumbersome components.

For example, one device has a lever mechanism connected to the trash container by a hinge. When the lever is lowered, a plate is pressed into the trash container, compacting the trash contained therein. The plate may be connected to the lever by a connecting arm that passes through the lid of the trash container, or the lid may be removed prior to using the lever. Such designs have several moving parts, and careful positioning of the plate may be required when the compacting mechanism is used to ensure that clothing or body parts are not pinched by the plate. Further, periodic cleaning of the plate may be necessary, e.g., to remove trash from the plate when it is lifted from the container. Another device for compacting trash uses a rigid, removable portion of the lid of a waste container. The removable portion is disengaged from the lid, and may be used to manually compact the trash contained therein. Requiring the user to remove or disengage a portion of the lid and then to replace it after compacting the trash is cumbersome and undesirable.

Even though existing devices may be effective, users continually seek easier and cleaner ways to compact trash in a container for disposal.

BRIEF DESCRIPTION OF THE DRAWINGS

Embodiments of the present invention will be best understood with reference to the following detailed description, when read in conjunction with the accompanying drawings, in which.

DETAILED DESCRIPTION

A trash container is disclosed that has a flexible, corrugated baffle attached to or integrated into the lid of the container. The baffle may have a handle and a compacting plate attached to it, and it allows a user to compact trash inside the trash container. Specifically, the flexible design of the baffle allows the compacting plate to compact trash inside the container when the baffle is extended into the container. After the trash inside the container is compacted, the baffle may spring back into its original shape. The lid structure, including the baffle, may be incorporated into the container, which may have other features, such as a foot pedal to raise and lower the lid. The baffle allows trash in the trash container to be reduced in size, allowing more trash to be placed in the container, while maintaining a simple design and keeping the user clean and safe by providing a resilient barrier on the lid.

Figure 1:
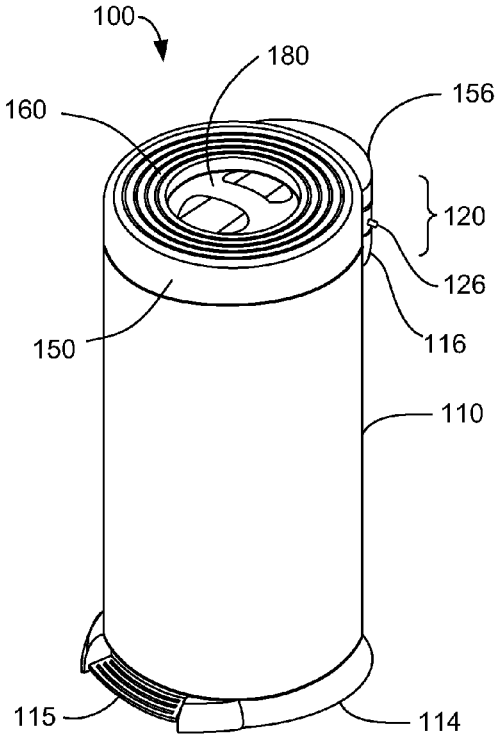
FIG. 1 illustrates a perspective view of a trash container in accordance with one or more embodiments of the invention.
Figure 2:
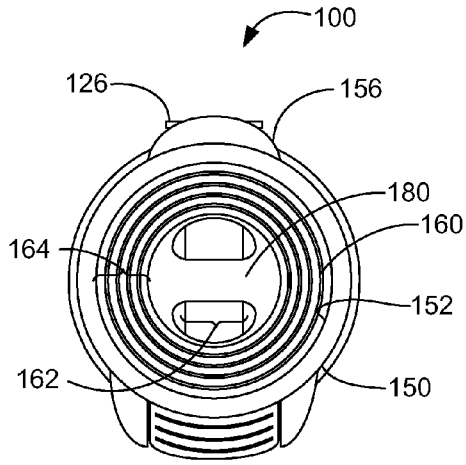
FIG. 2 illustrates a plan view of the trash container of FIG. 1.
Figure 3A:
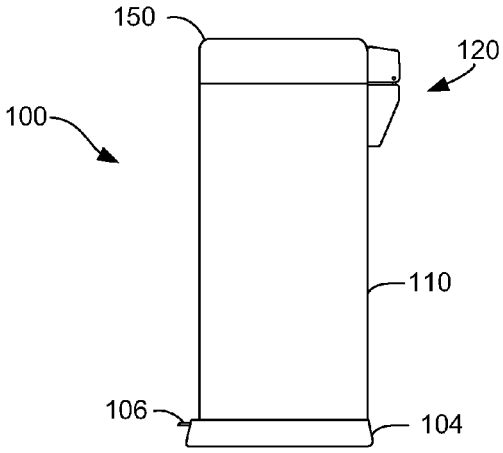
FIG. 3A illustrates a side view of the trash container of FIG. 1.
Figure 3B:
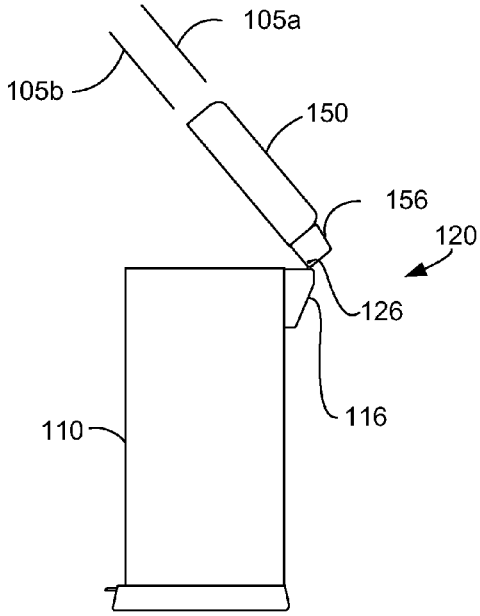
FIG. 3B illustrates a side view of the trash container with the lid raised.

A trash container 100 shown in FIGS. 1 and 2 includes a container body 110 and a lid 150. The container body 110 defines a chamber having an open end 112 that is covered by the lid 150. In the present embodiment, a hinge mechanism 120 connects the lid 150 to the body 110 and allows the lid 150 to open and close about the hinge mechanism 120, although the lid 150 may be a separate component in alternative embodiments. For the hinge mechanism 120, a lid joint 156 extending from the lid 120's edge connects by a hinge pin 126 to a base joint 116 affixed to the trash container body 110. In this way, the lid 150 can open and close about the base joint 116 via the hinge pin 126, as shown in FIGS. 3A-3B. The trash container 100 also includes a base 114 for stabilizing the trash container 100 and includes a pedal 115 for opening the lid 150 without requiring a user to open the lid 150 with their hands. This pedal 115 can use linkage components connected to the lid 150 so that pressing the pedal 115 raises the lid 150 as shown in FIG. 3B.

As best shown in FIG. 2, the lid 150 has a central opening 152 in which a baffle 160 and a handle 180 position. The baffle 160 has a central planar section 162 to which the handle 180 is attached and has an outer corrugated second 164 that surrounds the central section 162. In this outer section 164, a series of circumferential corrugations (e.g., three or four) expand outward from the central second 162 to the peripheral edge of the baffle 160. As explained below, these corrugations allow the baffle 160 to be extended into the container body 110 to compress trash, while maintaining a barrier between the user and the trash being compacted.

The baffle 160 is formed to be resiliently biased such that the baffle 160 remains in a space defined by the lid 150 when in an unextended position. This resilient, biased nature of the baffle 160 helps maintain the baffle 160 in the space of the lid 150 whether closed or open as shown in FIGS. 3A-3B. With the lid open as in FIG. 3B, for example, all portions of the baffle 160 and the handle 180 remain between upper and lower levels or planes 105*a* and 105*b* defined by the lid 150.

Figure 4A:
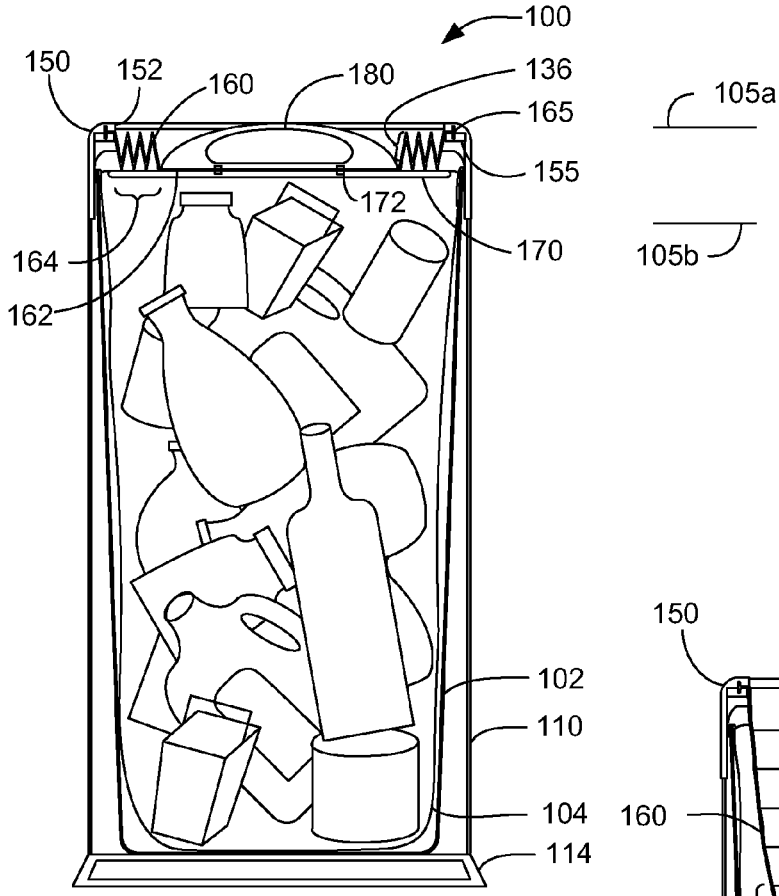
FIG. 4A is a cross-sectional view of a trash container in accordance with one or more embodiments of the invention before a trash compacting operation.
Figure 4B:
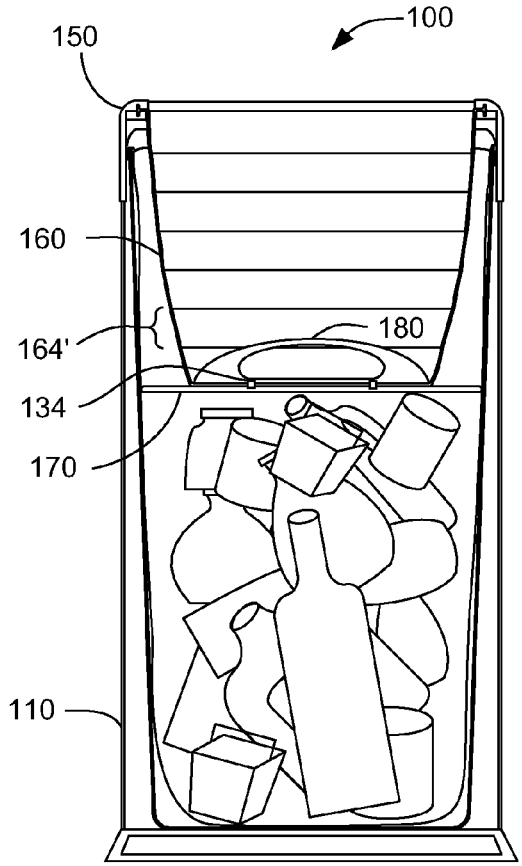
FIG. 4B is a cross-sectional view of the trash container of FIG. 4A during the trash compacting operation.
Figure 5:
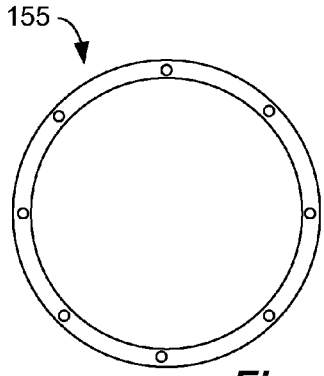
FIG. 5 is a plan view of a ring for attaching the baffle to the lid of the trash container in FIGS. 4A-4B.

FIGS. 4A and 4B show details for attaching the baffle 160 and the handle 180 to the lid 150. As shown in FIG. 4A, the lid 150 defines a circumferential groove on its underside around its central opening 152. A tab 165 on the peripheral edge of the baffle 160 positions in this groove, and a ring 155 holds the baffle 160's peripheral edge against the underside of the lid 150. The ring 155 shown in a plan view of FIG. 5 can be made of plastic or metal and can have a plurality of holes for screws or fasteners to pass through the baffle 160 and into the lid 150 to affix the baffle 160 to the lid 150. Other techniques for attaching the baffle 160 to the lid 150 are discussed later.

FIG. 4A also provides additional detail concerning the attachment of the handle 180 and a compacting plate 170 to the baffle 160. In general, the handle 180 and the plate 170 may be attached to the baffle 160 in a number of ways. For example, epoxy, adhesives, or the like can attach the handle 180 directly to the baffle 160 and can likewise attach the compacting plate 170 on the other side of the baffle 160. Alternatively, fasteners (e.g., rivets 172) can join the handle 180 on one side of the baffle 160 to the compacting plate 170 on the other side of the baffle 160. In this way, the handle 180 connects to the compacting plate 170 with the baffle 160 fixed between the handle 180 and the compacting plate 170. Either way, the handle 180 and the compacting plate 170 move in unison when the baffle 160 is extended into the chamber of the body 110 to compress trash.

The handle 180 and the compacting plate 170 may be attached in other manners as well. For example, screws or bolts, with or without nuts, may be used in a similar manner to the rivets 172. Alternatively, the attachment mechanism may be integrated into the handle 180 and the plate 170. For example, the handle 180 and plate 170 can have complementary recesses and tabs permitting the handle 180 and plate 170 to press fit together and sandwich portion of the baffle 160 therebetween.

FIGS. 4A-4B further show the trash container 100 during use to compact trash. In an initial state shown in FIG. 4A, the baffle's corrugated section 164 having alternating corrugations of ridges and grooves keeps the baffle 160 in its initial position level with the lid 150. Typically, a trash bag 104 lines the inside of the trash container 100 so that trash is placed inside of the trash bag 104 within the container 100. A removable liner 102 made from any suitable material, such as plastic or steel, may also be used to facilitate removal and replacement of the trash bag 104.

As mentioned briefly above, the baffle 160 is flexible, but also resilient, allowing a user to compact trash by pressing the baffle 160 with the handle 180 into the container's body 110. When extended as in FIG. 4B, the corrugated section 164 straightens and allows the compacting plate 170 to compact the trash inside the container 100. Thus, the plate 170 pressed into the body 110 by the handle 180 compacts the trash while the baffle 160 maintains a barrier between the user and the trash in the container 100. The baffle 160 may be extended any distance into the trash container 100 depending on the size and number of corrugations in the baffle's outer section 164.

After compacting the trash, the baffle 160 may then return by its own bias and resiliency to its initial state (FIG. 4A) when the user releases force on the handle 180. Alternatively, depending on the amount of vacuum produced within the container, the baffle 160 may be returned to its initial state by the user manually raising (i.e., lifting) the handle 180. To alleviate some of the potential vacuum produced in the container 100 when extending the baffle 150, one or more holes or one-way valves can be provided within the lid 150, the container body 110, or the liner 102 to allow airflow into the container 110 after the trash has been compacted. For example, a suitable location for such a hole or valve would be through the handle 180, baffle 160, and compacting plate 170 in the lid 150. Once trash is compacted, this hole or valve may allow airflow through the lid 150 and into the container body 110 to facilitate lifting of the extended baffle 160, plate 170, and handle 180.

Preferably, the baffle 160 is made from a flexible material such as silicone, but other flexible materials, such as certain forms of rubber, may also be used. The use of a flexible material such as silicone provides a simple design with minimal moving parts and provides a barrier for the user who is compacting trash with the handle 180. Additionally, after the trash is compacted as shown in FIG. 4B, the baffle 160 may spring back to its original shape (as shown in FIG. 4A), with little or no manipulation by the user, due to the biased nature of the corrugated baffle 160 and its resilient material.

Although embodiments according to the invention are discussed with reference to particular examples, it should be understood that numerous variations of the disclosed techniques are possible. Thus, it will be appreciated that any combination of the disclosed features may be included in the trash container 100. For example, the base 104, the foot pedal 106, and the hinge mechanism 120 may not be included in one or more embodiments. When the hinge mechanism 120 is not present, rather than being fixed to the container 100, the lid 150 of the trash container 100 may be completely removable from the container.

Figure 6:
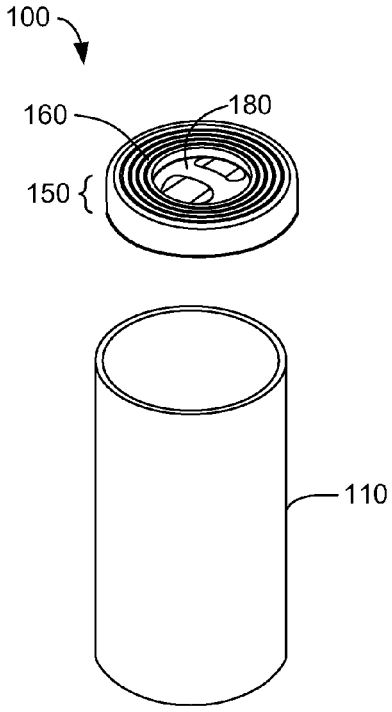
FIG. 6 is a perspective view of a trash container having a removable lid with a baffle.

For example, FIG. 6 shows an embodiment of a removable lid 150 for covering the open end 112 of a trash container 110. As with the previous embodiments, this removable lid 150 also has a corrugated baffle 160, compacting plate (not visible), and handle 180. The removable lid 150 may make the trash container 100 easier to use in certain applications, such as when trash bags are frequently exchanged in the container. Even though the baffle 160 is flexible, the handle 180 can still be used to lift this removable lid 150 from a container because the compacting plate can engage the inside of the lid 150 when lifted up. Moreover, the corrugations in the baffle 160 can be configured to bend and extend in one direction inward into the lid 150 and resist being folded in the opposite direction.

Figure 7:
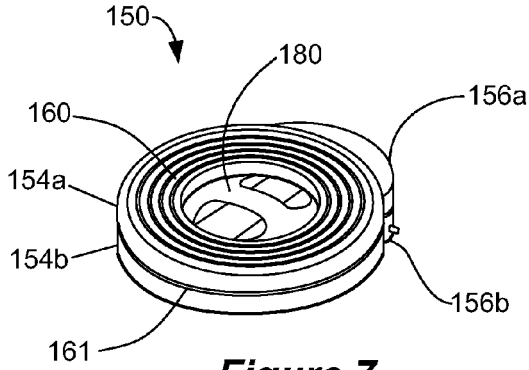
FIG. 7 is a perspective view of another embodiment of a lid for the disclosed trash container showing an alternative arrangement for attaching a baffle to the lid.

In alternative embodiments, other techniques for attaching the baffle 160 to the lid 150 can also be employed. In FIG. 7, for example, the lid 150 has an upper rim 154*a* and a lower rim 154*b* fixed to each other to form the primary circular shape of the lid 150. The lower rim 154*b* closes over the trash container (not shown) to seal trash inside the container. In the present embodiment, the baffle 160's peripheral edge 161 extends between the upper and lower rims 154*a-b*, and the rims 154*a-b* hold the baffle 160 in place using, for example, screws, rivets, adhesives (e.g., epoxy), etc. A portion of the baffle 160 can also be enclosed between upper and lower hinge portions 156*a-b*, which are parts of the hinge mechanism on the lid 150 if hingedly connected to a container. Although the baffle 160 does not need to be enclosed between the hinge portions 156*a-b*, this may be beneficial for proper spacing of each of the components should these components be formed from separate pieces.

Figure 8:
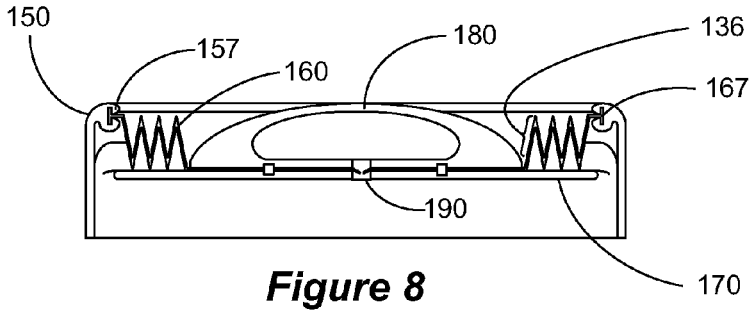
FIG. 8 is cross-sectional view of yet another embodiment of a lid for the disclosed trash container showing another arrangement for attaching a baffle to the lid.

In another example shown in FIG. 8, the lid 150 has a groove 157 defined about its central opening 152. In addition, the baffle 160 has a lip or tab 167 about its periphery. This lip 167 inserts into the groove 157 to keep the flexible baffle 160 attached to the lid 150. The press fit into the groove alone can hole the baffle 160, or additional fastening techniques, such as fasteners, epoxy, etc. can be used as well. For illustrative purposes, this embodiment of the lid 150 is shown having a one-way valve 190 passing through the handle 180, baffle 160, and compacting plate 170 to facilitate passage of air to break any vacuum produced when compacting trash. As noted previously, such a valve 190 can be used in other locations of the lid 150 or in the trash container and can be used in other embodiments disclosed herein.

As evidenced by the differing structures for attaching the baffle 160 to the lid 150, it should be apparent from the basis of this disclosure that the attachment of the baffle 160 to the lid 150 can be achieved in a number of ways. Further, while several techniques for attaching the handle 180 and plate 170 to the baffle 160 have been disclosed, it should be appreciated with the benefit of the present disclosure that other techniques could also be used. Further, the lid 150 and the hinge portion 156 shown in FIG. 1, for example, can be separate components connected together or can be formed as a single piece, e.g., molded from plastic in a single piece.

Although the body 110, base 114, and lid 150 are cylindrical in shape and have a circular cross-section as shown in FIG. 1, for example, the body 110, base 114, and lid 150 may be formed in any shape desirable for a trash container, such as having cross-sections that are oval, rectangular, square, hexagonal, etc. Similarly, the body 110, base 114, and lid 150 may be formed from any material suitable for the construction of a trash container. For example, the body 110, base 114, and lid 150 can be formed from plastic, although other materials such as steel and aluminum may also be used as well as combinations of such materials. For example, the body 110 may be formed from steel, while the base 114 and lid 150 may be formed from plastic.

Advantages of various embodiments according to the invention include one or more of the following. A built-in manual compactor in the lid of a trash container affords a simple design with few moving parts, and is thus less prone to failure. A corrugated baffle shape for the compactor, extendable into the trash container, allows trash in a trash container to be compacted without endangering a user or exposing the user to the trash contained therein. Thus, more trash may be placed in the container. Further, the use of silicone allows the baffle to spring back to an initial shape after compacting the trash, reducing the size of the compactor and providing a convenient design. Additionally, a user's hands may be kept clean and safe, as they do not have to touch the trash in the container. The additional use of a foot pedal allows the compactor assembly to be incorporated into a lid that can be raised and lowered without the use of the hands.

It should be understood that the disclosed apparatuses can be implemented in many different ways to the same useful ends as described herein. In short, it should be understood that the inventive concepts disclosed herein are capable of many modifications. To the extent such modifications fall within the scope of the appended claims and their equivalents, they are intended to be covered by this patent.

What is claimed is:

1. A trash container, comprising:

a body defining a chamber with an open end;

a lid hingedly attached to the body adjacent the open end and defining a central opening;

a baffle positioned in the central opening of the lid and having a peripheral edge attached to the lid, the baffle having first and second sides and being corrugated, the baffle being resiliently biased to an unextended position level with the lid and being resiliently extendable through the open end of the body and into the chamber;

a handle attached on a portion of the first side of the baffle and movable therewith; and a plate attached to a portion of the second side of the baffle and movable therewith, the plate compacting trash inside the chamber when moved with the baffle and handle into the chamber.

2. The trash container of claim 1, wherein the baffle comprises:

a central planar section attached to the handle on the first side and attached to the plate on the second side, and an outer corrugated section surrounding the central section, the outer section having a series of circumferential corrugations expanding outward from the central section to the peripheral edge of the baffle.

3. The trash container of claim 2, wherein the handle, when the baffle is in the unextended position, situates below a level defined by the lid.

4. The trash container of claim 2, wherein the baffle, when in the unextended position, situates between first and second levels defined by the lid.

5. The trash container of claim 1, wherein the lid comprises an upper rim and a lower rim, and wherein the peripheral edge of the baffle is fixedly positioned between the upper and lower rims.

6. The trash container of claim 1, wherein the central opening of the lid defines a groove, and wherein the peripheral edge of the baffle defines a lip fixedly positioned in the groove.

7. The trash container of claim 1, wherein the peripheral edge of the baffle positions adjacent the central opening of the lid, and wherein a ring fixedly attaches the peripheral edge to the lid.

8. The trash container of claim 1, wherein a hinge hingedly attaches the lid to the body.

9. The trash container of claim 1, wherein the body comprises a metal material.

10. The trash container of claim 1, wherein the lid comprises a plastic material, and wherein the baffle comprises a silicone material.

11. A trash container, comprising:

a body defining a chamber with an open end;

a lid positioned on the open end of the body, the lid at least including:

means attached to the body for opening the lid from the open end;

means movable into the chamber for compressing trash therein;

means for resiliently biasing the means for compressing to a level of the lid; and means for resiliently extending the means for compressing into the chamber when manually operated.

12. A trash container lid, comprising:

a lid body positionable on an open end of a trash container and having a central opening;

a baffle positioned in the central opening of the lid body and having a peripheral edge attached to the lid body, the baffle having first and second sides and being corrugated, the baffle being resiliently biased to an unextended position level with the lid body and being resiliently extendable through the open end of the trash container by manual pressure applied to the first side; and a plate attached to a portion of the second side of the baffle and movable therewith, the plate compacting trash inside the trash container when moved with the baffle into the chamber.

13. The lid of claim 12, further comprising a handle attached on a portion of the first side of the baffle and movable therewith.

14. The lid of claim 13, wherein the baffle comprises:

a central planar section attached to the handle on the first side and attached to the plate on the second side, and an outer corrugated section surrounding the central section, the outer section having a series of circumferential corrugations expanding outward from the central section to the peripheral edge of the baffle.

15. The lid of claim 13, wherein the handle, when the baffle is in the unextended position, situates below a level defined by the lid.

16. The lid of claim 12, wherein the baffle, when in the unextended position, situates between first and second levels defined by the lid.

17. The lid of claim 12, wherein the lid body comprises an upper rim and a lower rim, and wherein the peripheral edge of the baffle is fixedly positioned between the upper and lower rims.

18. The lid of claim 12, wherein the central opening of the lid body defines a groove, and wherein the peripheral edge of the baffle defines a lip fixedly positioned in the groove.

19. The lid of claim 12, wherein the peripheral edge of the baffle positions adjacent the central opening of the lid body, and wherein a ring fixedly attaches the peripheral edge to the lid body.

20. The lid of claim 12, wherein the lid body comprises a plastic material, and wherein the baffle comprises a silicone material.

* * * * *